United States Patent [19]

Beimgraben

[11] Patent Number: 4,462,472

[45] Date of Patent: Jul. 31, 1984

[54] MARINE BEARING FOR A DOWNHOLE DRILLING APPARATUS

[75] Inventor: Herbert W. Beimgraben, Houston, Tex.

[73] Assignee: Baker International Corporation, Orange, Calif.

[21] Appl. No.: 268,188

[22] Filed: May 29, 1981

Related U.S. Application Data

[63] Continuation of Ser. No. 023,421, Mar. 23, 1979, abandoned.

[51] Int. Cl.[3] ..... E21B 3/12

[52] U.S. Cl. ..... 175/320; 175/107

[58] Field of Search ..... 175/107, 228, 257; 415/502; 418/48; 308/8.2; 184/19

[56] References Cited

U.S. PATENT DOCUMENTS

| | | | |
|---|---|---|---|
| 2,991,837 | 7/1961 | Postlewaite | 175/107 |
| 3,112,801 | 12/1963 | Clark et al. | 175/107 |
| 3,149,685 | 9/1964 | Mitchell et al. | 175/107 |
| 3,210,962 | 10/1965 | Birdwell | 175/107 |
| 4,225,000 | 9/1980 | Maurer | 175/107 |

*Primary Examiner*—William F. Pate, III

*Attorney, Agent, or Firm*—Norvell & Associates

[57] ABSTRACT

A bearing supports a rotatable shaft in a fluid environment. The bearing can be utilized to support a drive shaft connected to a drill bit in a downhole drilling apparatus. The drive shaft extends through a housing in which drilling fluid is flowing. Preferably, the bearing includes an inner elastomeric sleeve and an outer rigid sleeve attached to the interior side wall of the housing. The drive shaft has a wear sleeve attached for rotation therewith. The wear sleeve is rotatably received in the bearing inner sleeve. The inner sleeve is relatively short as compared with the drive shaft and absorbs radial loads imposed on the drive shaft. The bearing is lubricated by a portion of the drilling fluid in the housing which flows between the exterior side wall of the wear sleeve and the interior side wall of the inner sleeve.

1 Claim, 11 Drawing Figures

MARINE BEARING FOR A DOWNHOLE DRILLING APPARATUS

This is a continuation, of application Ser. No. 023,421 filed Mar. 23, 1979 now abandoned.

CROSS-REFERENCE TO RELATED APPLICATIONS

This application is related in subject matter to co-pending application Ser. No. 023,202, filed Mar. 23, 1979, entitled "Field Pressure Actuated By-Pass and Relief Valve"; co-pending application Ser. No. 023,200, filed Mar. 23, 1979, entitled "Apparatus And Method For Closing A Failed Open Fluid Pressure Actuated Relief Valve"; co-pending application Ser. No. 023,199, filed Mar. 23, 1981, entitled "Universal Joint Apparatus For Separating Thrust And Torque Forces"; co-pending application Ser. No. 023,423, filed Mar. 23, 1979, entitled "Universal Joint Apparatus Having Sliding Plate Construction For Separating Thrust And Torque Forces"; co-pending application Ser. No. 023,422, filed Mar. 23, 1979, entitled "Improvements In Fluid Sealing Of A Universal Joint For A Downhole Drilling Apparatus"; co-pending application Ser. No. 023,420, filed Mar. 23, 1979, entitled "Metal-To-Metal Face Seal"; and co-pending application Ser. No. 023,419, filed Mar. 23, 1979, entitled "Apparatus For Applying Pressure To Fluid Seals". with each being assigned to the same assignee as this application.

BACKGROUND OF THE INVENTION

1. Field of the Invention

The present invention relates to a bearing for supporting a rotating shaft in a fluid stream.

2. Description of the Prior Art

Downhole drilling motors of the positive displacement type, embodying a rotor and stator arrangement of the Moineau type illustrated and described in U.S. Pat. No. 1,892,217, are well known. The rotor in prior drilling motors has one lobe operating within a companion two lobe stator made of rubber or corresponding elastomer material, the rotor itself being a solid member. The rotor partakes of an eccentric or orbital pass around the axis of the stator, producing an excessive amount of vibration as a result of the orbiting speed of the rotor, combined with its relatively high mass due to its solid construction, resulting in a decreased life of the rotor and of the parts of the motor associated therewith.

The drilling weight of prior motor apparatus is transmitted through a bearing assembly to the motor shaft, this bearing assembly being lubricated by the drilling mud or other fluid pumped down through the string of drill pipe and through the motor itself. Since drilling mud is very often sand laden, the bearings are operating in an abrasive liquid, resulting in their relatively short life, limiting the time that the motor can be used in drilling a bore hole, with consequent requirements for moving the entire motor apparatus from the bore hole and replacement of a substantial number of its parts, or, for that matter, replacement of the entire motor unit. Because of the use of the solid rotor, a dump valve assembly is incorporated in the drilling string above the motor to allow the drilling fluid to fill the drill pipe as the apparatus is run in the bore hole and to drain from the drill pipe while coming out of the hole.

U.S. Pat. No. 3,112,801, entitled "Well Drilling Apparatus", incorporates therein a bearing which is pressed into a liner which in turn is pinned within a casing. A drill shaft extends through the casing and is supported by the bearing. The inner face of the bearing can have longitudinally extending grooves for conducting fluid to the lower thrust bearings. However, this bearing is not self-lubricating and does not provide shock absorbing means.

The present apparatus is provided with a bearing assembly in the drilling motor that is sealed against entry of external fluids and substances, such as the drilling mud. The bearing assembly is filled with oil maintained at a higher pressure than the pressure externally of the bearing assembly, thereby insuring clean oil acting upon the bearings themselves which contributes to the long life of the bearing assembly, enhancing its ability to transmit drilling weight from the drilling string and stator or housing portion secured thereto and to the drill bit, as well as its ability to resist radial or lateral motion of the motor shaft within the stator or housing.

The apparatus also provides a bearing assembly in a fluid drilling motor which is capable of safely transmitting greater drilling weights from the drill string and stator or housing to the drill bit. More particularly, a plurality of thrust bearings are used in which one of the bearings normally carries the weight being imposed on the drill bit up to a predetermined amount, an additional bearing being brought into operation to transmit drilling weight to be imposed on the bit in excess of the predetermined amount.

SUMMARY OF THE INVENTION

Typically, a downhole drilling apparatus includes a fluid actuated motor having a drive shaft attached to a drill bit, the motor and the drive shaft being coupled by a universal joint. The drilling fluid which is forced through the motor flows through the housing through which the drive shaft extends. The drive shaft is rotatably supported in the housing by a marine bearing.

The bearing includes an inner sleeve retained in an outer sleeve attached to the interior side wall of the housing. A wear sleeve is attached to the drive shaft for rotation therewith and is rotatably received by the inner sleeve. The inner sleeve is relatively short as compared with the drive shaft and is formed of an elastomeric material which absorbs radial loads imposed on the drive shaft. The bearing is lubricated by a portion of the drilling fluid flowing through the housing which flows between the exterior side wall of the wear sleeve and the interior side wall of the bearing inner sleeve.

DESCRIPTION OF THE PREFERRED EMBODIMENTS

Figure 1:
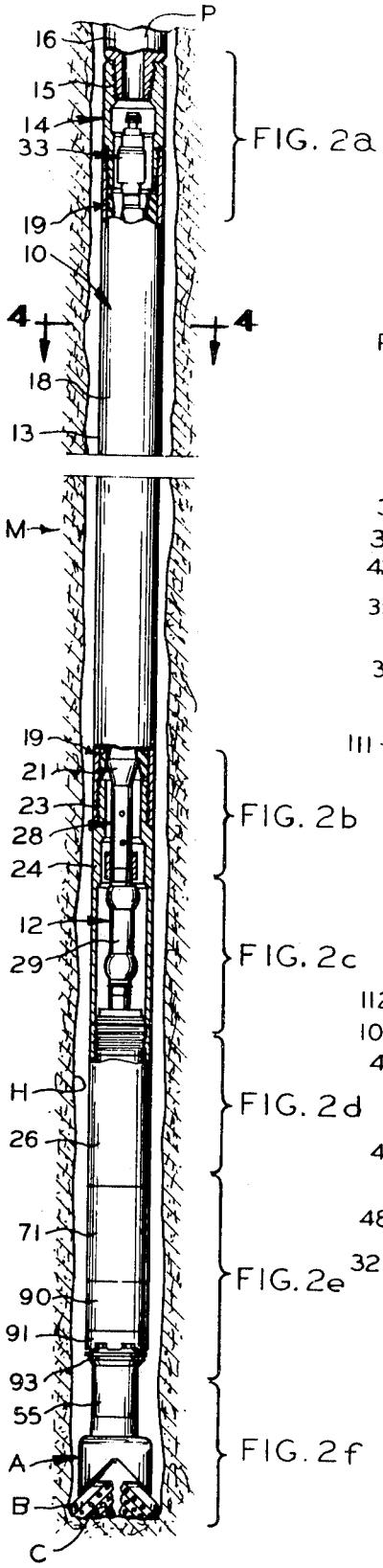
FIG. 1 is a side elevational view of a hydraulic downhole drilling motor secured to a string of drill pipe and a drill bit in a bore hole
Figure 3A:
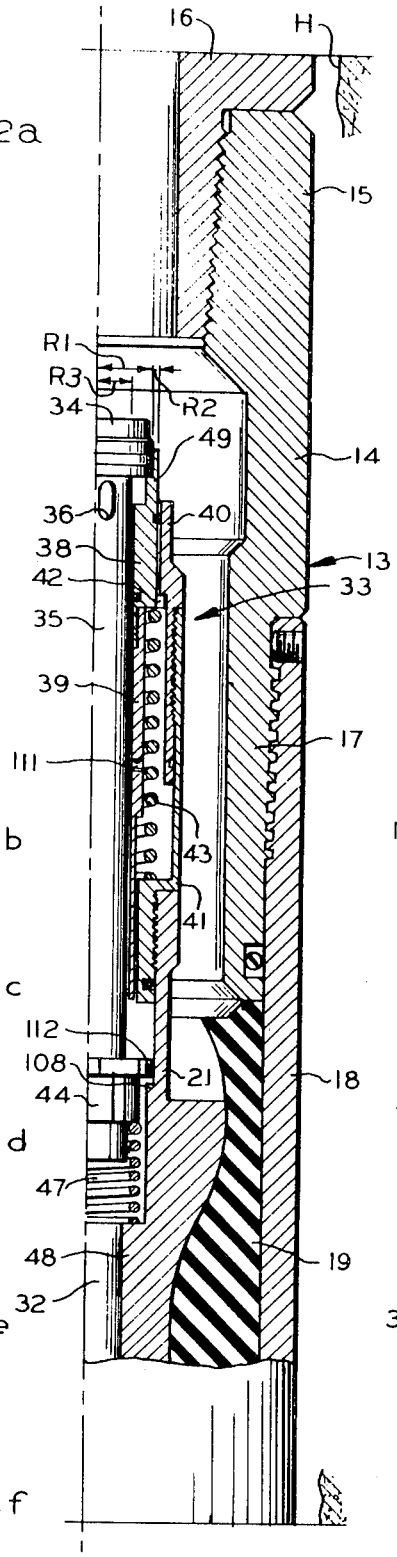
FIGS. 3*a* and 3*b* are enlarged fragmentary quarter sectional views of the valve assembly of FIG. 2*a* in the closed and relief positions respectively.
Figure 3B:
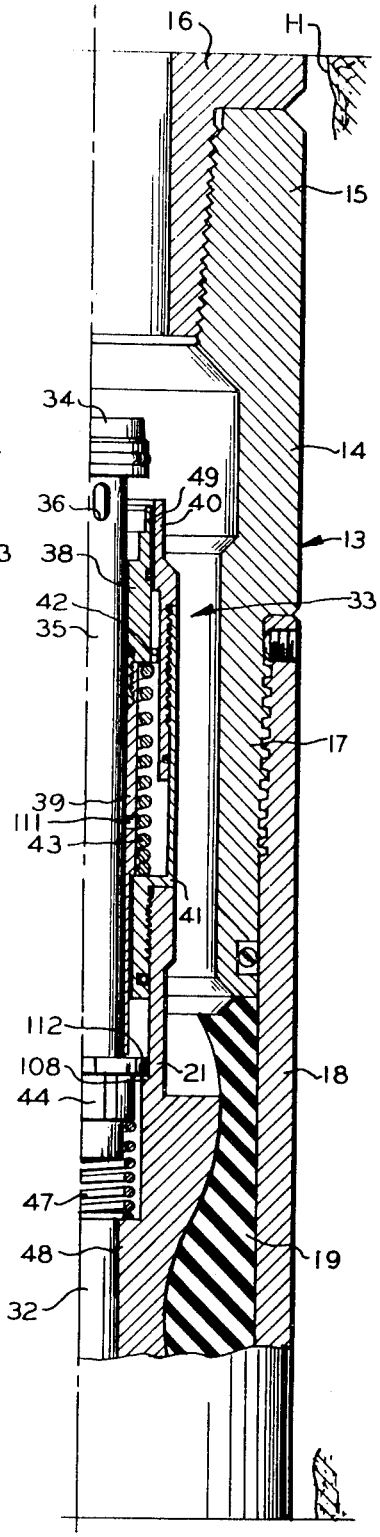

A hydraulic downhole drilling motor M is illustrated in the drawings, the upper portion of which is connected to a tubular string P, such as a string of drill pipe extending to the top of a bore hole H, such as an oil or gas well being drilled, and the lower end of which is secured to a suitable rotary drill bit A having cutters B for operating upon the bottom C of the bore hole. The drilling motor includes an upper hydraulic motor portion 10 and a lower drive shaft portion 11 connected to the rotary drill bit, a universal joint assembly 12 being disposed between the upper and lower portions. As disclosed, and now referring to FIGS. 1 and 2*a*, an outer housing structure 13 is provided, including an upper sub 14 having a threaded box 15 threadedly secured to a lower pin 16 of an adjacent drill pipe section P, this sub having a lower pin 17 threadedly secured to an outer stator housing 18. The stator housing has mounted therein an elongate elastomer rubber or rubber-like stator 19 having steeply pitched helical lobes or threads 20 coacting with an elongate metallic hollow rotor 21 having steeply pitched helical lobes or threads 22 companion to the stator lobes. Details of the stator and rotor lobes and their coaction are unnecessary to an understanding of the present invention, since they are described in U.S. Pat. No. 1,892,217. The number of stator lobes 20 is one more than the number of rotor lobes 22.

Now referring to FIGS. 2*b*, 2*c*, 2*d* and 2*e*, a lower threaded box 23 of the stator housing 18 is threadedly secured to the upper end of an intermediate housing portion 24, a lower box end 25 of which is threadedly secured to a lower housing portion or section 26. Thus, the outer housing structure 13 comprises the upper sub 14, the outer stator housing 18, the intermediate housing portion 24, the lower housing portion 26 and the bearing housing 71. The portions 26 and 71 enclose a bearing assembly 27 extending between the motor shaft 11, and the housings 26 and 71, and which have the purpose of resisting radial movement of the drive shaft within the housing structure, and for transmitting drilling weight from the string of drill pipe P through the housing structure 13 to the drill bit A, to force the cutters B against the bottom C of the bore hole (as shown in FIG. 1).

The hollow rotor 21 terminates in a tubular extension 28 secured to the upper end of a universal joint subassembly 29. The extension 28 has side ports 30 in fluid communication between a central passage 31 in the extension and the interior of the intermediate or universal housing 24. The central passage 31 communicates with the internal passage 32 in the rotor 21 extending to the upper end thereof. The passage 32 is capped by a by-pass and relief valve assembly 33.

The valve 33 is utilized to fill and drain the drill pipe during lowering and lifting respectively. However, the valve 33 also actuates at a predetermined fluid pressure to allow fluid to flow through the interior of the rotor 21 to prevent over torqueing of the motor during drilling operations. The valve will open at the predetermined fluid pressure and close at a lower predetermined fluid pressure to prevent chattering. Such operation is accomplished by increasing the area upon which the fluid pressure acts when the relief valve opens.

When lowering or lifting the drill pipe, there is no fluid being pumped into the drill pipe. Therefore, the valve 33 is in its normally open position to allow fluid in the well or in the drill pipe to by-pass through the rotor 21. When drilling begins, the fluid pressure closes the valve 33 and the fluid is forced between the rotor 21 and the stator 19. When the fluid pressure exceeds the predetermined fluid pressure, the relief portion of the valve is actuated and the fluid again will by-pass the motor to prevent damage thereto.

Figure 2A:
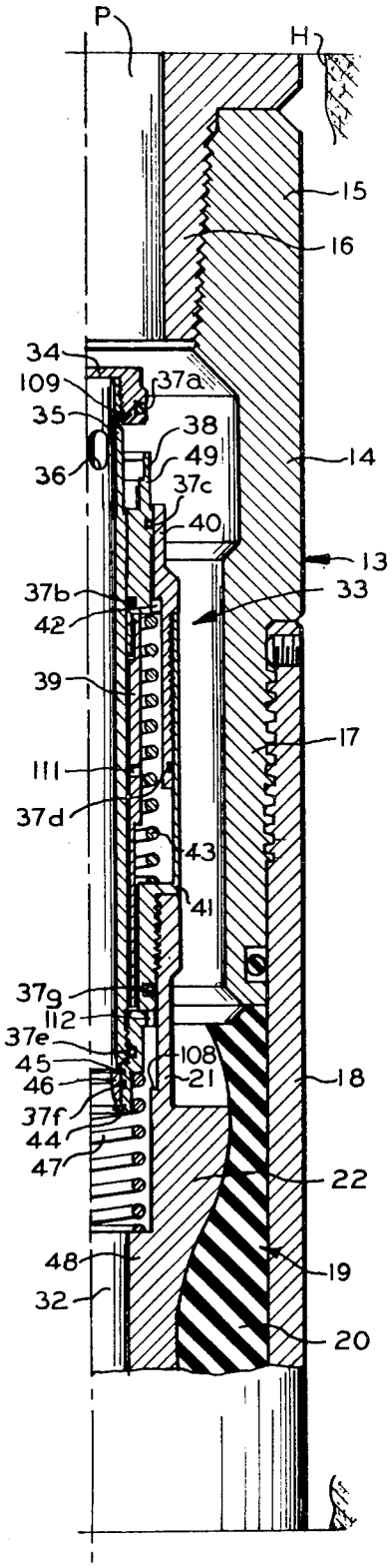
FIGS. 2*a*, 2*b*, 2*c*, 2*d*, 2*e* and 2*f* are enlarged quarter sectional views in side elevation of the drilling apparatus of FIG. 1.

As shown in FIG. 2*a*, a sliding sleeve cap 34 is threadedly secured to the upper end of a hollow mandrel 35 having openings 36 formed in the side wall thereof and in fluid communication with the hollow interior of the upper sub 14. The cap 34 has a radial groove formed in the exterior thereof for retaining an O-ring 37*a* or other type of seal. An orifice 109 is formed in the cap 34 for fluid communication between the groove for the O-ring 37*a* and the lower end of the cap 34. This is a low pressure area that assists in maintaining the seal 37*a* in its groove. The mandrel 35 is movable longitudinally in a sliding sleeve 38 and a sliding sleeve extension 39. The sleeve 38 has a radial groove formed in the interior wall thereof for retaining an O-ring 37*b* which sealingly engages the exterior surface of the mandrel 35. The lower end of the sleeve 38 is reduced in diameter and has threads formed thereon for engaging threads formed on the inner surface of the upper end of the extension 39. An orifice 111 is formed in the side wall of the extension 39 and slots are formed in retainer 44 to allow fluid communication between the spring cavity, described below, and the interior of the rotor 21 below the orifice 46.

The mandrel 35, the sleeve 38 and the sleeve extension 39 are also movable longitudinally in a sliding sleeve housing 40 and a compressed spring housing 41. The sleeve 38 has a radial groove formed in the exterior wall thereof for retaining an O-ring 37*c* which sealingly engages the interior wall of the housing 40. The housing 40 has an internal flange which engages a stop 42 formed on the exterior surface of the sleeve 38. The lower end of the sleeve housing 40 has external threads formed thereon for engaging internal threads formed on the upper end of the spring housing 41. A radial groove is formed in the exterior wall at the extreme lower end of the sleeve housing 40 for retaining an O-ring 37*d* which sealingly engages the interior wall of the spring housing 41.

The spring housing 41 has a reduced diameter lower end which forms the upper end of a flange. Thus, the sleeve 38, the sleeve extension 39, the sleeve housing 40 and the spring housing 41 form a cavity for retaining a helical relief valve spring 43. The upper end of the spring 43 abuts the lower surface of the larger diameter portion of the sleeve 38 and the lower end abuts the upper surface of the flange of the spring housing 41. The spring 43 exerts pressure tending to force the stop 42 against the internal flange of the sleeve housing 40.

The lower end of the spring housing 41 abuts the upper end of an orifice retainer 44. The retainer 44 has threads formed on the interior wall thereof for engaging threads formed on the exterior wall of the lower end of the mandrel 35. The retainer 44 also has a first radial groove formed in the interior wall thereof for retaining an O-ring 37*e* which sealingly engages the end portion of the exterior wall of the mandrel 35 below the threads. The retainer 44 is stepped intermediate its ends to form an internal flange which abuts the lower end surface of the mandrel 35. The lower portion of the retainer 44 has a second radial groove formed in the interior wall thereof to receive the outer portion of a snap ring 45. The lower end of the retainer 44 has an inwardly facing radial flange formed thereon, this flange and the snap ring 45 cooperating to retain a replaceable tubular orifice 46 therebetween. The retainer 44 has a third radial groove formed in the interior wall thereof intermediate the lower end flange and the snap ring groove for retaining an O-ring 37*f* which sealingly engages the exterior wall of the tubular orifice 46.

The lower end of the spring housing 41 has threads formed on the external wall thereof for engaging like threads formed on the internal wall of the upper end of the rotor 21. Thus, the upper end wall of the rotor 21 abuts the lower wall of the flange between the upper and lower portions of the spring housing 41. The extreme lower end of the spring housing 41 has a radial groove formed in the outside wall thereof for retaining an O-ring 37*g* which sealingly engages the interior wall of the rotor 21. A helical compression spring 47 has its upper end abutting the exterior step in the retainer 44 and its lower end bearing against an internal shoulder 48 in the rotor 21.

OPERATION OF BY-PASS AND RELIEF VALVE ASSEMBLY

The operation of the bypass and relief valve assembly 33 shown in FIG. 2*a* in the unactuated position, is fully described in my above-mentioned co-pending applications and will not be further described.

UNIVERSAL JOINT

Figure 2B:
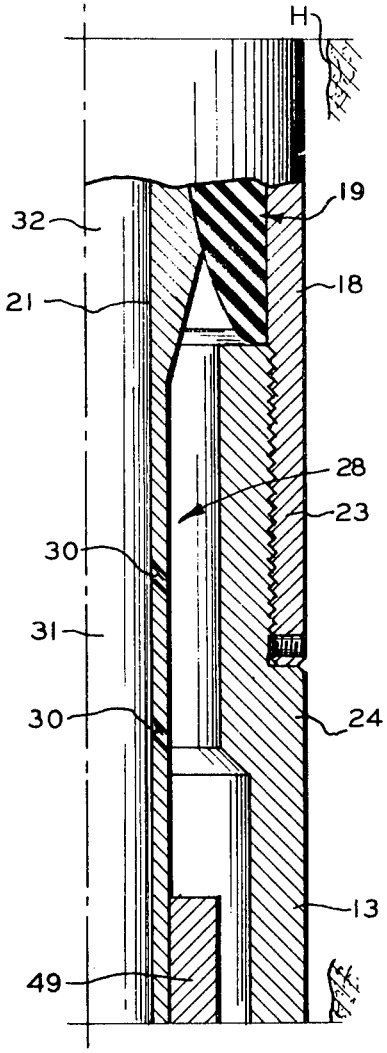
Figure 2C:
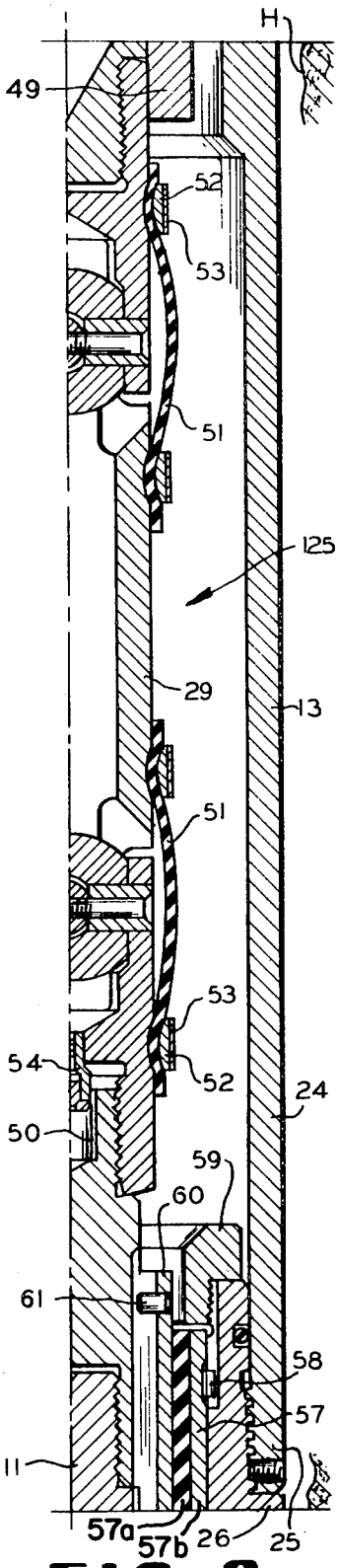

As shown in FIGS. 1 and 2*b*, the lower end of the rotor extension 28 is threaded into a recess (not shown) in the upper end of the universal joint subassembly 29 which is shown in more detail in FIG. 2*c*. A tubular pipe protector 49 is placed over the junction of the extension 28 and the universal joint 29. As the rotor 21 rotates, the protector 49 rubs against the interior of the housing 24 providing stabilization for the lower end of the rotor. This relieves the radial load on the universal joint and protects the stator 19 from high side loads.

The universal joint subassembly 29 includes a commercially available double universal joint. The joint subassembly 29 includes two universal joints with an upper end of the subassembly threadedly attached to the rotor extension 28 and a lower end threadedly attached to the upper end of a drive shaft extension 50 of the drive shaft 11. Since the rotor 21 moves in an eccentric or orbital path around the longitudinal axis of the stator 19 during its rotation, the subassembly 29 transmits such motion to the motor drive shaft 11. Each of the joints is enclosed by an elastic cover 51 secured at either end by a clamp to prevent drilling mud or other fluids flowing through the housing 24 from entering the universal joint structure and adversely affecting the universal joints.

Each clamp comprises a C-ring 52 that is compressed with a strap clamp 53 to squeeze the cover into an arcuate groove formed in the exterior of the subassembly. In this manner, a predetermined force can be exerted and there are no sharp edges to cut the cover. The drive shaft extension 50 is threaded into a recess in the lower end of the subassembly 29. A check valve 54 is threaded through the bottom wall of the lower end recess to communicate with the hollow interior of the universal joint subassembly. Oil or grease can be forced into the subassembly through the valve 54 to slightly "balloon" the covers 51. Under the hydrostatic conditions at the bottom of the well, any air trapped in the lubricant will tend to compress, but the excess lubricant will prevent the covers from coming into contact with the moving parts of the joint, thus, extending the life of the covers.

DRIVE SHAFT

There is shown in FIGS. 2*c*, 2*d*, 2*e* and 2*f* the drive shaft portion 11 of the drilling assembly. The lower end of the drive shaft 11 has a threaded box 55 formed thereon for receiving a threaded pin 56 of the drill bit A. The upper end of the drive shaft 11 is threaded into the drive shaft extension 50. A marine bearing 57 having an elastomeric inner sleeve 57*a* attached to an outer rigid sleeve 57*b* rests on a flange formed on the interior side wall of the upper end of the housing 26. A key 58 is retained by a slot in both the exterior side wall of the bearing 57 and the interior side wall of the housing 26 to prevent relative rotation therebetween. A bearing lock nut 59 is threadably received by the upper end of the housing 26 to retain the bearing 57.

A bearing sleeve 60 is attached to the drive shaft extension 50 in sliding contact with the marine bearing 57 and resting against the lower flange of the extension 50. A radially extending screw or pin 61 is secured in the side wall of the extension 50 for retaining bearing sleeve 60. Channels are formed in the exterior surface of the extension 50 to permit fluid flow between the extension and the bearing sleeve. However, a small amount of this fluid flows between the bearing sleeve 60 and the marine bearing 57 to lubricate the marine bearing. The marine bearing stabilizes the drive shaft 11 and absorbs radial loads transmitted from the universal joint subassembly.

The drive shaft 11 has a plurality of ports 62 formed in the side wall thereof. The exterior of the drive shaft side wall is threaded below the ports for receiving a tubular drive shaft nut 63. An internal radial groove is formed in the upper end of the nut 63 for retaining an O-ring 64 which sealingly engages the side wall of the drive shaft 11. The upper end of the nut 63 above the O-ring groove is of increased internal diameter to form a shoulder.

A tubular spring retainer 65 has an upper end proximate the lower ends of the marine bearing 57 and the sleeve 60. An external flange is formed on the upper end of the retainer 65 which has a lower face which abuts the upper end of a helical spring 66. A tubular piston sleeve 67 has internal threads formed on the upper end thereof for engaging threads formed on the exterior side wall of the retainer 65. The sleeve 67 has an increased diameter lower end which rests upon an internal radially extending flange formed on an upper stationary seal retainer 68. The housing 26, the retainer 65, the sleeve 67 and the retainer 68 form a cavity or cylinder for retaining the spring 66. A ring type piston 69 is disposed in the lower portion of the cavity for sliding movement therein and the upper surface of the piston abuts the lower end of the spring 66. The piston 69 also has an internal and an external radial groove formed therein for retaining O-ring 70 which sealingly engage the exterior side wall of the sleeve 67 and the interior side wall of the housing 26.

The lower end of the retainer 68 is supported by the upper end of a bearing housing 71 which threadedly engages the lower end of the housing 26. During assembly, the cavity below the piston 69 is filled with lubricant, typically oil, through an opening in the side wall of the housing 26 which opening is then closed with a check valve as will be discussed below. The lubricant can be drained through another opening in the housing 26 which normally is closed with a plug 72. The lubricant is inserted under pressure and tends to force the piston 69 upwardly compressing the spring 66. During normal operation, the spring 66 will maintain the lubricant under a pressure which exceeds the fluid pressure externally thereby preventing fluid from entering the bearing as will be discussed below. The location of the piston 69 in the cavity is a good indicator of the amount of oil in the bearing section, the location of which is determined by taking a pressure reading of the lubricant. Furthermore, the piston does not come into contact with the rotating parts such that a better seal is effected than in the prior art devices.

The lower end of the drive shaft nut 63 abuts the upper end of a tubular upper guide sleeve 73 which is keyed for rotation with the drive shaft 11. The sleeve 73 has an internal radial groove formed therein for retaining an O-ring 74 which sealingly engages the exterior side wall of the drive shaft 11. A seal subassembly 75 has an upper end attached to the lower end of the piston sleeve 67 and a lower end attached to the upper end of the housing 71. A central portion of the subassembly 75 is keyed to the upper guide sleeve 73 for rotation therewith. The seal subassembly will be discussed in more detail below.

The lower end of the sleeve 73 abuts the upper surface of an inner race 76 of a cylindrical roller bearing 77. The race 76 is supported by a spacer sleeve 78 which in turn is supported by a thrust bearing thrust ring 79. The bearing 77 is supported by a spacer sleeve 80 which in turn is supported by a thrust bearing spacer 81. A cylindrical roller thrust bearing 82 is retained between the ring 79 and the spacer 81.

A similar bearing assembly is positioned below the thrust ring 79 and includes a lower bearing spacer sleeve 83, a cylindrical roller thrust bearing 84, a bearing support and retainer 85, an inner race 86, a cylindrical roller bearing 87, a lower guide sleeve 88, and a seal subassembly 89. The retainer 85 has a radially outwardly extending flange formed at the upper end thereof which is supported on the upper end of a lower seal housing 90. The upper end of the housing 90 threadably engages the lower end of the bearing housing 71.

A cylindrical end cap 91 is attached to the lower end of the housing 90 by suitable threaded fasteners. A seal retainer 92 is threadably received in the upper end of the end cap 91 to retain the lower end of the seal subassembly 89. The upper end of the seal subassembly is attached to the seal housing 90 and a central portion is keyed for rotation with the sleeve 88. A drive shaft collar 93 is pinned to the threaded box 55 and is keyed to the sleeve 88.

Figure 2D:
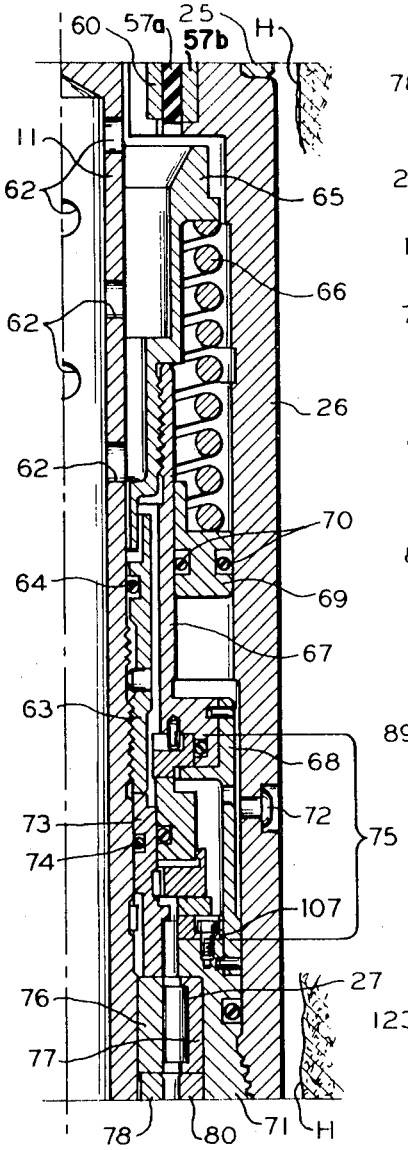
Figure 2E:
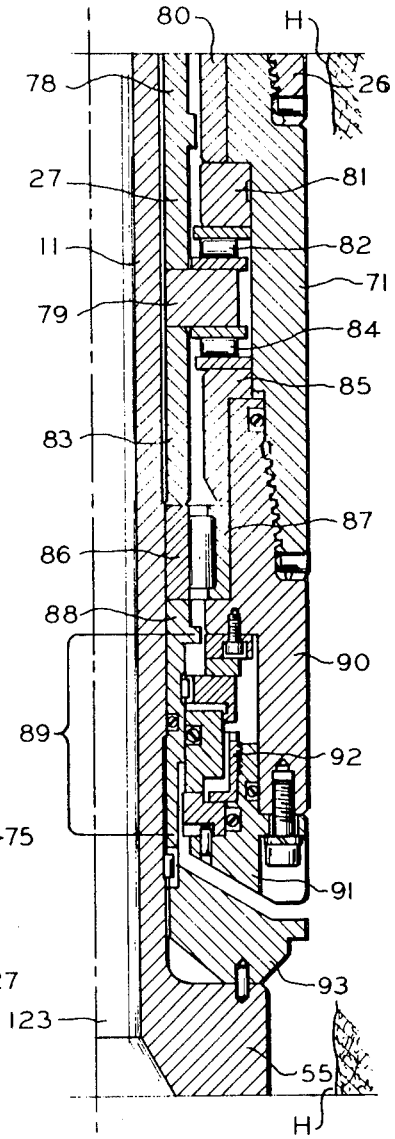
Figure 2F:
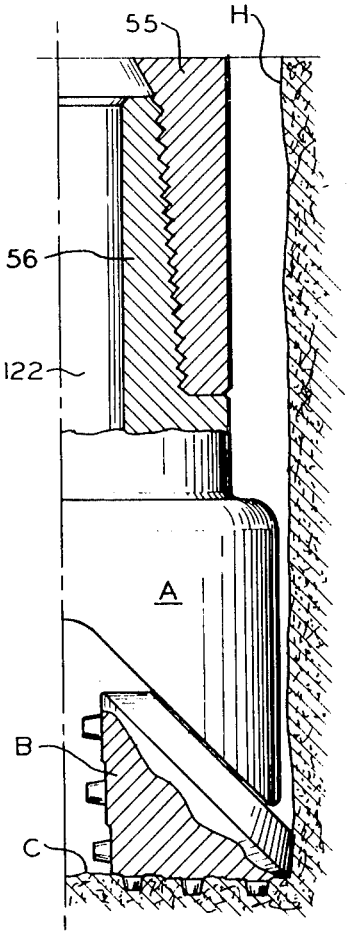
Figure 4:
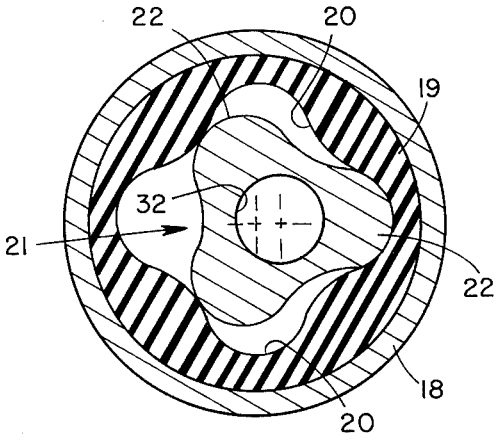
FIG. 4 is a cross-sectional view taken along the line 4—4 of FIG. 1.
Figure 5:
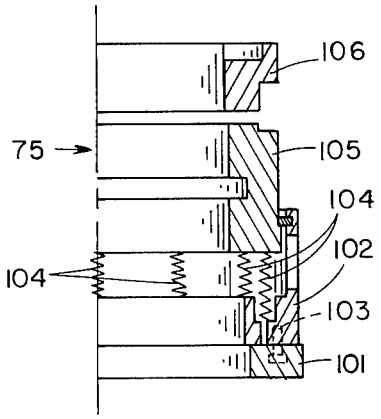
FIG. 5 is an enlarged fragmentary quarter sectional view of the seal subassembly of FIG. 2*e*.

Although not shown in FIG. 2*e*, there is an opening formed in the side wall of the lower seal housing 90 for receiving a check valve (not shown) and a removable plug (not shown) similar to the plug 72. With the plug removed, lubricant under pressure can be forced into the interior of the bearing assembly.

The drilling mud, or other fluid external to the bearing assembly is prevented from entering by the pressurized lubricant and the seal subassemblies 75 and 89.

There is shown in FIG. 11 an enlarged quarter sectional view of the seal subassembly 75 which is similar to the seal subassembly 89. A thrust bearing washer 101 is attached to a retainer ring 102 by suitable threaded fasteners 103. The ring 102 has a plurality of apertures formed in the lower face thereof for receiving the upper ends of helical springs 104. The lower ends of the springs abut the lower surface of an upper rotating seal 105. The retainer is keyed to the upper guide sleeve 73 (FIG. 2*d*) for rotation with the drive shaft 11. The above-identified elements abut a stationary seal 106 which is pinned to the piston sleeve 67 (FIG. 2*d*).

The seals 105 and 106 are made from metal and are maintained in face-to-face contact by the springs 104 to provide sealing at very low pressure. The washer 101 rotates against a thrust bearing seat 107 such that the retainer 102 is supported by the housing rather than the drive shaft. This type of seal can accommodate radial run-out better than an elastomeric type seal and is well balanced against high pressure and reverse pressure. This seal can also accommodate axial oscillation.

OPERATION OF MOTOR

In normal use, the drill bit A is secured to the lower end of the drive shaft 11 and the upper sub 14 is secured to the lower end of the string of drill pipe P. As the drilling apparatus is lowered through the drilling fluid in the bore hole H to the bottom C thereof, the by-pass and relief valve 33 is open to permit fluid to flow upwardly through jets or nozzles (not shown) in the drill bit A. The fluid flows into a central passage 122 in the bit, through a central passage 123 in the drive shaft, out the ports 62 into the annular space above the bearings, through the marine bearing 57 and the channels in the drive shaft extension 50, and into the space 125 between the housing 24 and the universal joint subassembly 29. The fluid then enters the side ports 30 of the central passage 31 and continues up the internal passage 32 of the hollow rotor 21, through the open valve 33 and into the drill pipe P.

When the bit A reaches the bottom C of the bore hole H, drilling mud or other fluid is pumped down through the drill pipe P. At a predetermined pressure, the valve 33 closes directing the fluid to flow between the rotor 21 and the stator 19 such that the rotor rotates. The fluid follows the above-described path in the opposite direction to discharge from the bit A for cleaning the cutters and flushing the cuttings in a lateral outward direction and upwardly through the annular space between the drilling apparatus and the bore hole.

During the drilling operation, an appropriate drilling weight is imposed on the drill bit A by allowing a portion of the weight of the drill pipe P to rest upon the housing structure 13. This weight is transmitted from the upper sub 14, through the housing 18, the housing 24, the housing 26, the bearing housing 71, the thrust bearing spacer 81, the thrust bearing 82, the thrust ring 79, the spacer sleeve 83, the inner race 86, the guide sleeve 88 and the drive shaft collar 93. The weight is then transferred through the threaded box 55 to the bit A to force its cutters B against and into the bottom C of the bore hole H.

In the event that the drill bit A is lifted from the bottom C of the bore hole while fluid is being pumped through the drilling motor M, and the rotor 21, universal joint 12, drive shaft 11 and bit A are rotated, the thrust ring 79 will rest upon the lowermost axial bearing 84 to support the downward thrust imparted on the rotor by the drilling fluid exerting against the lobes 22, and the weight of the bit drive shaft 11 and the universal joint thereabove.

In summary, the present invention concerns a marine bearing utilized in a downhole drilling apparatus. The bearing rotatably supports a drive shaft attached to a drill bit, the drive shaft extending through a housing in which drilling fluid is flowing. The bearing includes an elastomeric inner sleeve and a rigid outer sleeve attached to the interior side wall of the housing whereby radial loads imposed on the drive shaft are absorbed by the elastomeric inner sleeve. The drive shaft can include a wear sleeve attached for rotation therewith in the inner sleeve. Lubrication for the bearing is provided by a portion of the fluid flowing in the housing flowing between the exterior side wall of the wear sleeve and the interior side wall of the inner sleeve.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A drive shaft and bearing for concurrently supplying driving torque and drilling mud to a well drilling bit, comprising a plurality of axially extending external grooves on said drive shaft for transmitting drilling mud to a drilling bit mounted on the bottom portions of the drive shaft; a stationary tubular housing surrounding the grooved portion of said drive shaft; three concentric sleeves mounted between said grooved portion of the drive shaft and the bore of the housing; the inner sleeve being rigid and secured to the drive shaft in overlying relationship to said axial grooves; the outer sleeve being rigid and keyed to the housing; the central sleeve being formed of elastomeric material secured to the bore of said outer sleeve and being rotatable relative to said inner rigid sleeve and lubricated by flow of drilling fluid between the external surface of the inner sleeve and the bore of the elastomeric center sleeve; and axially spaced, internally projecting means on said housing for securing said outer sleeve against axial displacement.

* * * * *